US005842900A

United States Patent [19]

Hodge

[11] Patent Number: 5,842,900

[45] **Date of Patent: *Dec. 1, 1998**

[54] PHOTO DOLL

[76] Inventor: Gloria Hodge, Rte. 3, Box 59-B, Charleston, Ark. 72933

[ * ] Notice: This patent issued on a continued prosecution application filed under 37 CFR 1.53(d), and is subject to the twenty year patent term provisions of 35 U.S.C. 154(a)(2).

[21] Appl. No.: 773,095

[22] Filed: Dec. 24, 1996

[51] Int. Cl.[6] ..... A63H 3/00; B42F 13/00; A46G 1/06

[52] U.S. Cl. ..... 446/73; 40/775; 402/79

[58] Field of Search ..... 446/73, 72, 321, 446/337, 71, 320, 369, 371; 40/633, 768, 775, 776; 402/79; 281/2, 38, 40, 41

[56] References Cited

U.S. PATENT DOCUMENTS

| | | | |
|---|---|---|---|
| D. 348,293 | 6/1994 | Hodge . | |
| 2,902,996 | 9/1959 | Callen | 40/776 X |
| 3,751,839 | 8/1973 | Mitchell | 40/775 |
| 3,881,220 | 5/1975 | Glass et al. | 446/321 |
| 4,197,670 | 4/1980 | Cox . | |
| 4,365,433 | 12/1982 | Buell | 40/776 |
| 4,573,927 | 3/1986 | Newman | 446/321 X |
| 4,776,823 | 10/1988 | Hanlon | 446/321 |
| 4,795,397 | 1/1989 | Stevens . | |
| 4,822,285 | 4/1989 | Summerville . | |
| 4,828,526 | 5/1989 | Schneider et al. | 446/337 X |
| 4,832,648 | 5/1989 | Theobald et al. . | |
| 4,850,927 | 7/1989 | Caranica . | |
| 4,874,340 | 10/1989 | Smallwood . | |
| 4,995,221 | 2/1991 | Stemmer, Jr. | 40/775 |
| 5,000,319 | 3/1991 | Mermelstein | 40/776 |
| 5,046,985 | 9/1991 | Cearfoss . | |
| 5,059,149 | 10/1991 | Stone . | |
| 5,119,574 | 6/1992 | King | 40/776 X |
| 5,403,224 | 4/1995 | Gintling | 446/321 |

*Primary Examiner*—Robert A. Hafer
*Assistant Examiner*—D. Neal Muir
*Attorney, Agent, or Firm*—Richard C. Litman

[57] ABSTRACT

A stuffed doll or toy includes a main body section from which a plurality of appendages extend, representative of arms and legs. A displaceable panel or layer is shiftably attached to the fabric of the main body section and may include representations of facial features. A user of the doll may selectively open the displaceable panel to expose one or more intermediate layers therebeneath, each capable of housing a photograph or identification sheet. Separable fastener elements such as hook and loop components serve to attach the displaceable panel and intermediate layer(s) in a closed position substantially flush with the main body section. Projections from the panel may be grasped to displace the panel and expose the intermediate layer(s). Each intermediate layer is provided with a backing member and a slotted overlying transparent member to accommodate photographs or ID sheets inserted therebetween.

2 Claims, 3 Drawing Sheets

PHOTO DOLL

BACKGROUND OF THE INVENTION

1. Field of the Invention

This invention relates generally to dolls and more particularly to a doll provided with integral structure allowing for the removable insertion of disparate articles such as photographs or other graphic representations.

2. Description of the Prior Art

It is generally known to provide stuffed or plush toys or dolls with disparate devices intended to enhance the function or amusement level of the toy. Early examples of such toys or dolls comprise the inclusion of various sound-making mechanisms, beginning with dolls that simulate crying and advancing to dolls emitting numerous other sounds and even series of words. Other examples include dolls that ingest liquids and even dolls that subsequently wet a diaper.

Many children find attraction in a doll or toy that may be personally modified according to the child's desires or that of their parents. In this respect, it is desirable to be able to provide a convenient mechanism by which a doll or the like can be supplied with an attached photograph and/or other type of graphical representation such as an identification card, preferably in combination with a displaceable body portion of the doll, such as a face panel.

An example of a doll provided with a shiftable body panel will be found in U.S. Pat. No. 4,197,670 issued Apr. 15, 1989 to Cox and which includes a swingable body panel operable to expose internal anatomical features of the doll. This is in contrast to the present invention wherein an outer panel, which may include distinguishing features of the doll, is displaceable to expose one or more generally planar leaves or inserts containing photos or identification data.

In the case of U.S. Pat. No. 4,795,397 issued to Stevens on Jan. 3, 1989, a doll is disclosed having an identification panel affixed to its chest or trunk and which is at all times exposed to view. This is unlike the instant construction wherein one or more substantially planar leaves or the like serve to house photos or ID sheets and are covered by a swingable panel which may contain depictions of specific body features such as graphical facial expressions.

The stuffed toy animal shown in U.S. Pat. No. 4,822,285 issued Apr. 18, 1989 to Summerville discloses a further example of a displaceable body flap which is operable to expose anatomical features. Again, this is contrary to the present device wherein displacement of a body flap serves to expose one or more photos and/or ID items.

U.S. Pat. No. 4,832,648 issued May 23, 1989 to Theobald et al. illustrates the broad concept of a stuffed figure toy and planar sheets containing indicia but wherein the toy features comprise a book cover having arm sections between which a book is adapted to be disposed. The current invention on the other hand proposes a displaceable body panel containing graphical items representing facial features and beneath which are housed one or more displaceable sheets containing photos and/or ID data.

A spherical or round stuffed toy figure is shown in U.S. Pat. No. 4,850,927 issued to Caranica on Jul. 25, 1989 and which includes a facial representation surrounded by a plurality of stitched plush rings. Unlike the instant development, the facial portion is not displaceable to expose one or more leaves or panels containing photos or the like.

The broad concept of a stuffed toy having displaceable panels will be found in U.S. Pat. No. 4,874,340 issued Oct. 17, 1989 to Smallwood and which includes a book-like member having a stuffed toy figure on its cover and inside, a plurality of displaceable pages of fabric containing a children's story. This is distinguishable from the current invention wherein a panel on the exterior of a doll figure is shiftable to expose one or more photo/ID panels.

In U.S. Pat. No. 5,046,985 issued Sep. 10, 1991 to Cearfoss, a doll is shown having a shiftable panel normally overlying its face and whereupon when lifted, one may draw distinct custom facial features on an exposed markable surface. This is unlike the present doll construction wherein a displaceable doll body panel is manipulated to expose one or more inserts or panels accommodating photos and/or ID indicia.

U.S. Pat. No. 5,059,149 issued to Stone on Oct. 22, 1991 teaches the concept of a stuffed toy animal having a body panel that is shiftable to expose printed material. The body panel comprises a flap overlying the toy's trunk section. With the instant invention, the displaceable panel preferably defines facial features and when shifted, exposes one or more stacked leaves or panels containing photos and/or ID data.

None of the above inventions and patents, taken either singly or in any combination, is seen to even remotely suggest or describe the instant invention as claimed herein.

SUMMARY OF THE INVENTION

By the present invention, an improved stuffed toy or doll is produced and which includes an outer body panel containing distinctive features such as facial details which may include eyes, ears, nose, mouth, dimples etc. This body panel is displaceably attached to the underlying doll body by releasable fastener means, such as hook and loop type fasteners, so that it may be opened or removed to expose one or more leaves, pages or holders adapted to house photographs and/or printed indicia representing data applicable to either the doll or its child owner. As the removable outer cover or panel presents primary graphical features of the doll, substitution of alternate outer panels allows one to dramatically alter the appearance of the doll while the underlying leaves permit ready changing of the inserted photos and/or ID sheets.

Accordingly, one of the objects of the present invention is to provide an improved stuffed toy or doll having a displaceable body panel selectively operable by the user.

Another object of the present invention is to provide an improved stuffed toy or doll having a displaceable body panel shiftable to an alternate position to expose one or more photographs and/or identification panels.

A further object of the present invention is to provide an improved stuffed toy or doll having a shiftable, changeable panel containing graphical representations of specific body features.

Still another object of the present invention is to provide an improved stuffed toy or doll having a shiftable outermost panel containing facial features and overlying one or more leaves each adapted to house replaceable photographs or other indicia with the outermost panel capable of being replaced with an alternative panel.

These and other objects of the present invention will become readily apparent upon further review of the following specification and appended claims.

BRIEF DESCRIPTION OF THE DRAWINGS

Similar reference characters designate corresponding parts throughout the several figures of the drawings.

DETAILED DESCRIPTION OF THE PREFERRED EMBODIMENTS

Figure 1:
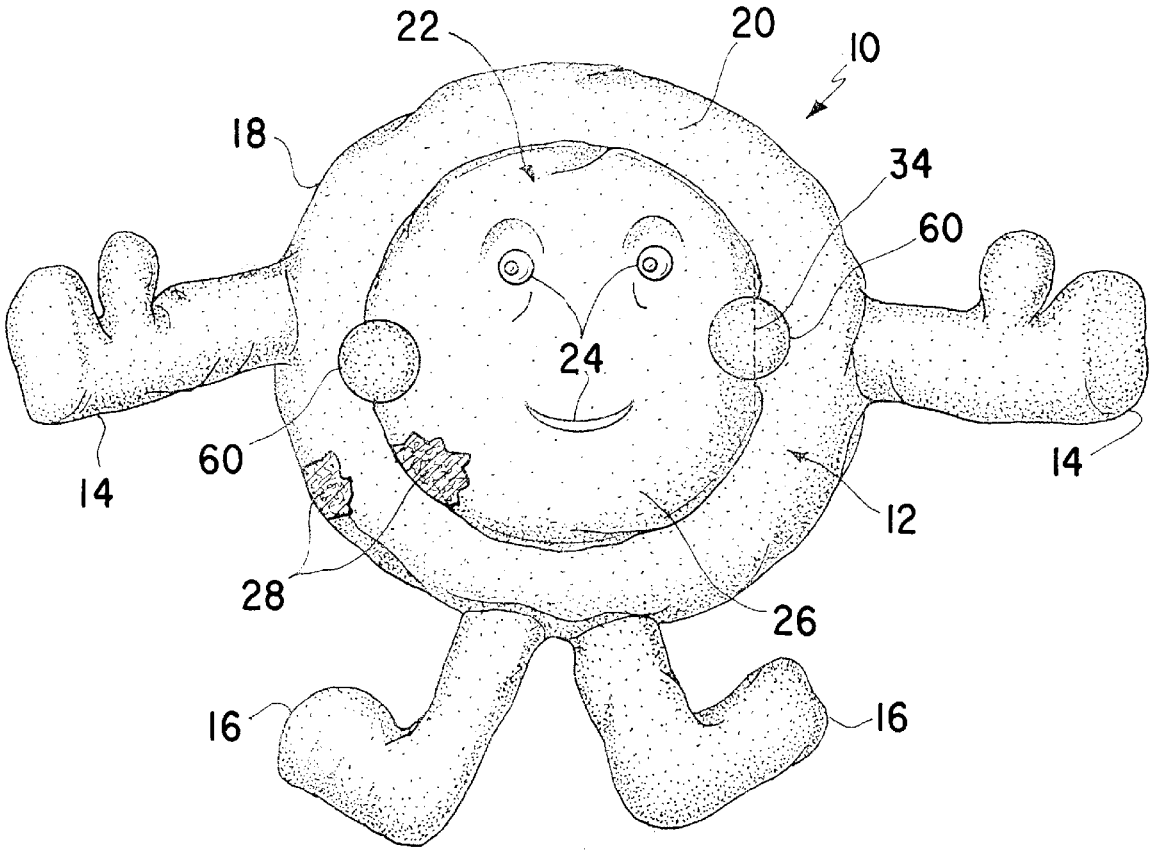
FIG. 1 is a front elevation of a stuffed toy or doll according to the present invention.

Referring now to the drawings, particularly FIG. 1, the present invention will be seen to relate to a stuffed doll or toy figure, generally designated 10 and including a main body section 12. The specific configuration of the doll may define any of numerous shapes and accordingly, the round configuration shown in the drawings will be understood to merely depict an exemplary shape carrying out the features of the present invention.

Depending from the main body section 12 are a plurality of appendages such as the illustrated arms 14—14 and legs 16—16, each projecting from the outer periphery 18 of the main body section 12. The main body section as well as the appendages 14 and 16 will be understood to be filled with a suitable lightweight material as is well known in stuffed toys, in order to provide bulk and stability to the doll 10. In this manner, the outer fabric layer 20 will yield a limited degree of resilience and result in a toy that may be considered soft rather than hard to the touch.

The main body section 12 is provided with a displaceable or shiftable layer or panel 22 and which, as shown in the embodiment of FIG. 1, contains graphical body representations 24. In this instance, these representations will be seen to comprise facial features such as eyes and a mouth. These features may comprise graphics printed upon the fabric layer 26 of the panel 22 or, appliqued elements suitably affixed thereto., such as by stitching or adhesive. To avoid unsightly wrinkling or sagging of the displaceable panel 22, it too is constructed to provide at least a limited degree of free-standing firmness and thus may comprise either a quite bulky stiff fabric or, two layers of fabric containing suitable stuffing or filler material 28 therebetween, as shown in cut-away portion of FIG. 1.

Figure 2:
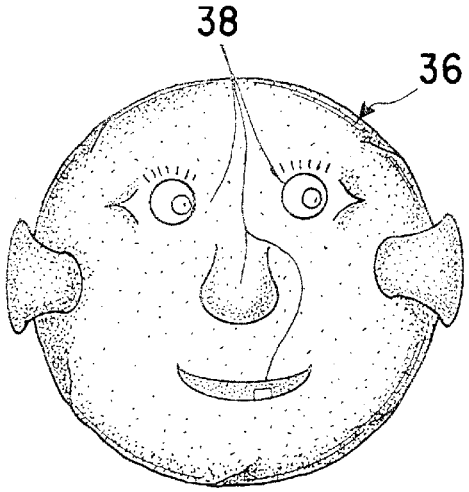
FIG. 2 is a front elevation of an alternate body panel.

The shiftable panel 22 is intended to be selectively displaced from the normally closed position shown in FIG. 1 wherein it flushly engages the main body section 12, to an opened position as shown in FIG. 2, in order to expose one or more intermediate layers or leaves 30,32 each adapted to house or support a photograph or identification sheet or card. The outer panel 22 may comprise a distinct, separable member or alternatively, be integrally attached along a common edge, with the next underlying layer 30. In the latter instance, the outer panel 22 and intermediate layer 30 may be formed by folding a single member along one edge or may comprise two separate elements stitched or otherwise fastened together along one side, as at 34 in FIG. 1. Otherwise, with the former instance, the outer panel comprises a separate element, thereby permitting the user to completely remove one outer panel 22 and to substitute an alternative outer panel 36 such as depicted in FIG. 2 of the drawings. With this arrangement, a child may alter the appearance of the doll 10 by attaching another outer panel 36 presenting graphical representations 38 offering different facial expressions.

Figure 3:
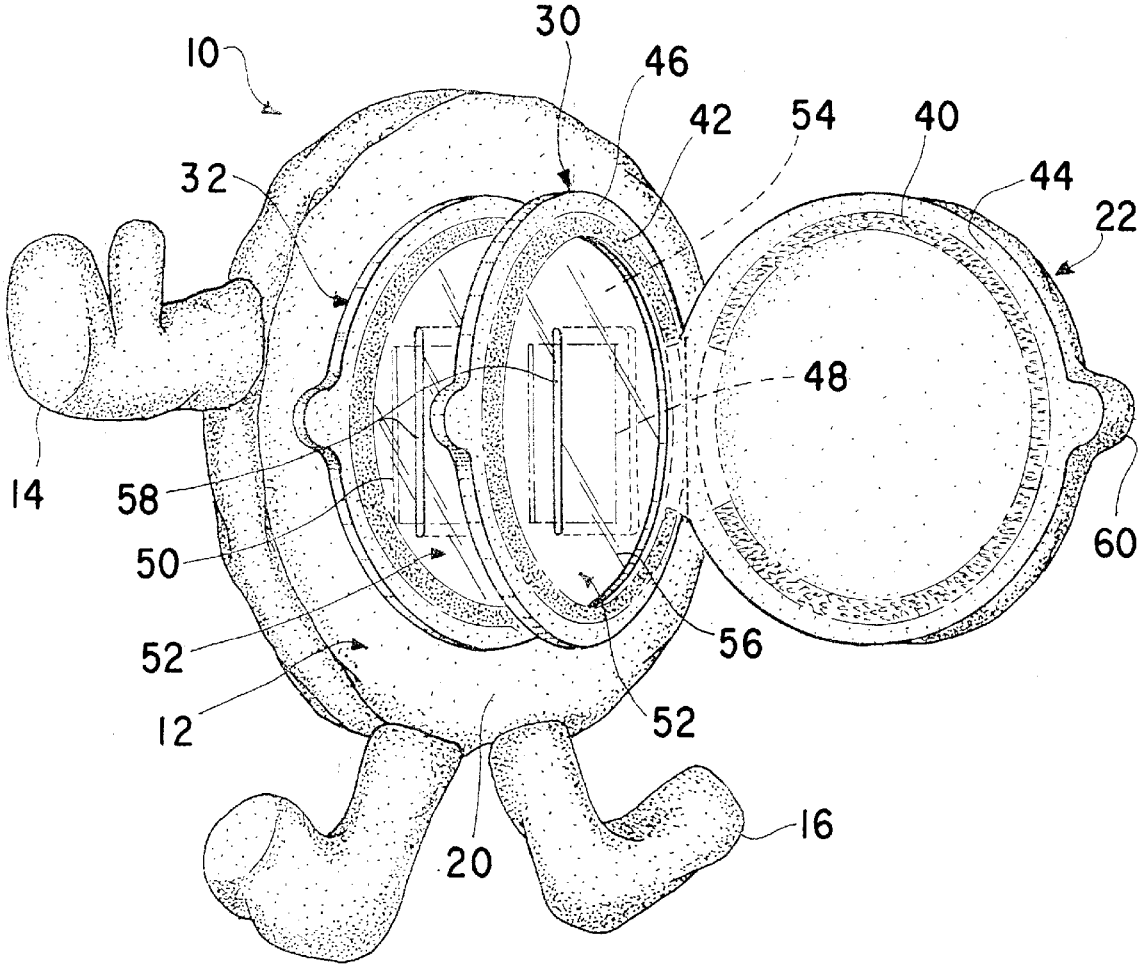
FIG. 3 is front perspective view of the doll of FIG. 1 illustrating the front panel opened to expose a plurality of normally hidden inserts each housing a photograph or ID sheet.

Upon opening or displacing the outer panel 22 as in FIG. 3, the user is able to view the one or more intermediate layers or leaves 30,32. The outer panel 22 is normally retained in the closed or normal position of FIG. 1 by suitable releasable fastening elements such as mating hook and loop components 40,42 respectively carried by the opposed inner surface 44 of the outer panel 22 and front surface 46 of the intermediate layer 30. When a plurality of leaves 30,32 are employed, the same type of releasable fastening is utilized to permit selective separation or opening of any one intermediate layer relative any overlying layer. As with the outer panel 22, the intermediate layers 30,32 may be affixed along one side edge as by stitching or the like or alternatively, may be fully separable by providing separable, mating fastener components 40,42 as the sole attachment means between the various layers, thus omitting the stitching or other permanent fixation as previously described and by including the hook and loop components throughout the peripheries of the layers as depicted by broken lines in FIG. 3.

Each intermediate layer 30,32 will be understood to allow for the removable insertion of a photograph 48 and/or other graphical representation such as an identification sheet 50 containing data relative either the doll or the child to whom it belongs. In this regard, each layer 30,32 will be seen to include an insert element 52 capable of mounting for visual observation, either a photo or ID sheet. Maximum security and protection against soiling may be provided by using an insert element comprising a backing member 54 having an overlying transparent member 56 and wherein the sheet to be displayed may be inserted and removed from between the two members 54,56 through an access slot 58 in the overlying member 56.

In addition to the graphical representations 24 on the outer panel 22, there will be seen two substantially diametrical projections 60,60 representing ears for the doll. These latter elements additionally offer functional structure to the doll 10 by providing grasping elements enabling ready displacement of the outer panel 22 between its two positions. Accordingly, it will be appreciated that when the outer panel is attached to the doll main body section 23 along its right-hand edge, a user merely grasps the over-hanging or outwardly projecting lefthand 'ear' 60 to swingingly open the outer panel to expose the underlying intermediate layer 30 and its contained photo or ID. In the case of an outer panel 22 which is fully removable from the doll main body 12, the user may then lift either or both 'ears' 60,60 to remove and view the exposed intermediate layer 30 and its contents and to alternately replace the outer panel 22 with a different outer panel 36.

Figure 4:
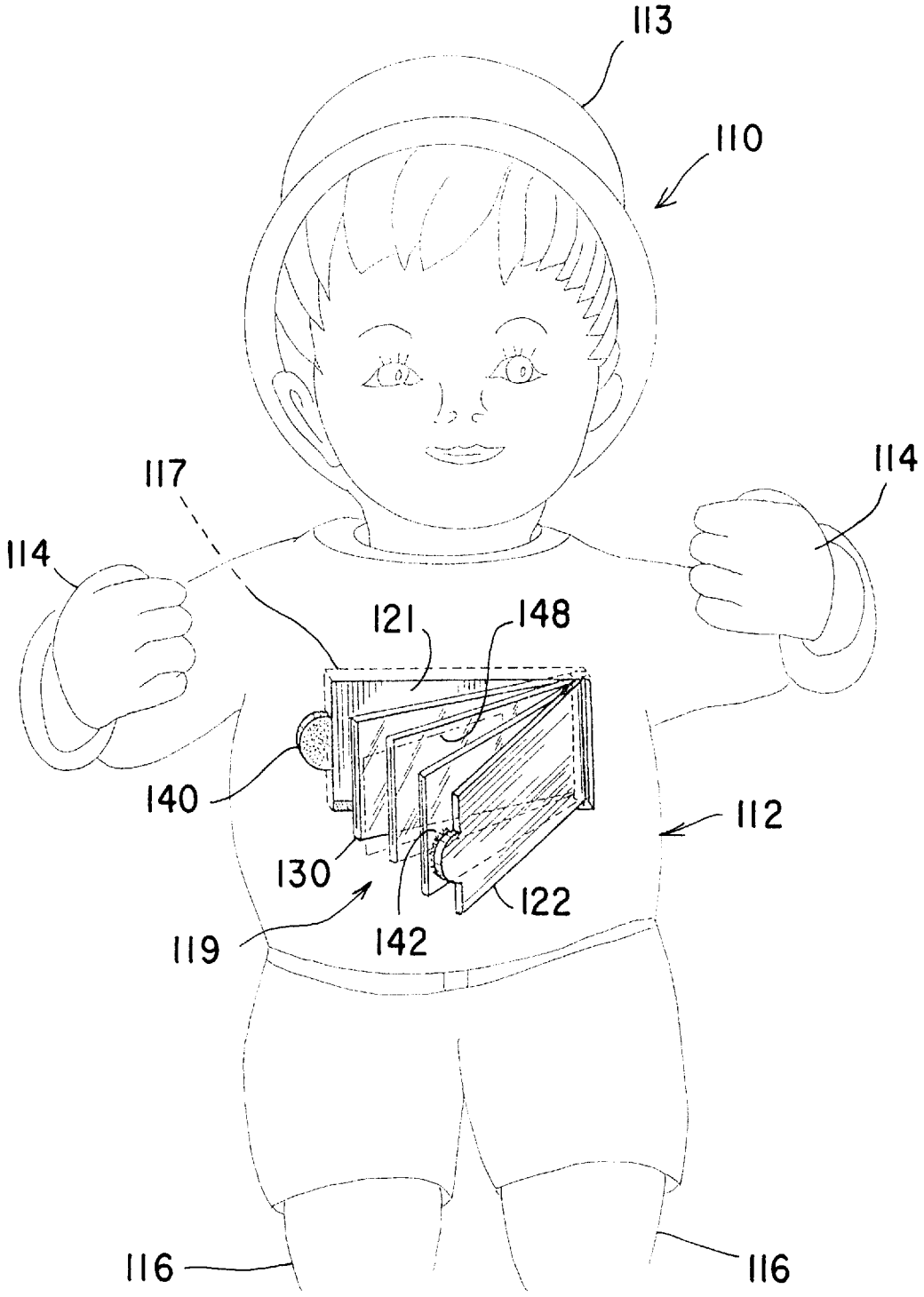
FIG. 4 is a partial front perspective view of a doll according to a second embodiment of the invention which illustrates the front panel opened to expose a plurality of normally hidden inserts each housing a photograph or ID sheet.

A second embodiment of the present invention is illustrated in FIG. 4, where a stuffed doll or toy figure generally denoted as 110 is shown. Similar features or elements present in both the first and second embodiments will be referred to by similar reference numerals increased by a factor of one hundred. Thus, the stuffed doll 110 comprises a main body section 112 from which a head portion 113 and a plurality of appendages in the form of arms 114—114 and legs 116—116 depend. Like the first embodiment, the main body section 112, the head portion 113 and the appendages 114 and 116 may be filled with any suitable lightweight material to provide bulk and stability to the doll, as is well known in the art.

The main body section 112 is provided with a recess 117 into which an insertable member generally denoted as 119 may be removably or permanently inserted. The insertable member 119 comprises a base 121 which may be used removably to secure the insertable member within the recess 117 using hook and loop fasteners, or other mating fasteners and the like. In contrast, the base may be permanently affixed within the recess using an adhesive or by joining the base to the doll with sewn stitches. Without regard to how the insertable member 119 is inset into the recess 117 of the main body, the insertable member 119 is provided with an outer shiftable panel 122 and a plurality of intermediate layers or leaves 130. The shiftable panel 122 may be formed of a transparent plastic material (as shown in FIG. 4), or one or more fabric layers as illustrated with respect to the first embodiment. The shiftable panel 122 may be removably or permanently secured to the insertable member 119. If the shiftable panel 122 is removably secured to the insertable member, a user of the doll may replace the shiftable member 122 as discussed with respect to the first embodiment. If the shiftable panel 122 is permanently secured to the insertable member 119 as shown in FIG. 4, the panel is integrally attached along a common edge with the intermediate layer 130 immediately below.

Although not shown for the second embodiment, the shiftable outer layer may be secured in a closed position whereby the intermediate layers 130 are contained within the recess 117 and possibly hidden from view (depending upon whether the outer layer 122 is transparent or opaque). The outer layer 122 may be secured in such a closed position using suitable releasable fastening elements such as mating hook and loop components 140,142 which are secured to opposed surfaces on the main body 112 of the doll and the outer layer 122, respectively. To release the shiftable outer layer, a user may separate the hook and loop fastening components 140,142, which allows a user to open the shiftable outer layer 122 to expose the intermediate layers 130 beneath. The intermediate layers 130 are constructed as previously described with respect to the first embodiment; thus, exposure of the intermediate layers allows a user to remove or replace a photograph 148 and/or other graphical representation such as an identification sheet containing data relative to either the doll or the child to whom it belongs.

From the foregoing it will be appreciated that a unique stuffed toy or doll is provided and wherein any portion of the doll's body includes a shiftable outer panel that is selectively displaceable to expose one or more underlying leaves or layers each housing a photograph or ID sheet and wherein the outer panel may be fully removable to permit substitution of an alternative outer panel containing different graphical representations of the doll body or face.

It will be understood that the present invention is not limited to the embodiments described hereinabove, but encompasses any and all embodiments within the scope of the appended claims.

I claim:

1. A stuffed doll comprising:

a main body section having a recess formed therein;

a pair of stuffed arms projecting outwardly from said main body section;

a pair of stuffed legs projecting outwardly from said main body section;

a head projecting outwardly from said main body section; and an insertable member secured within said recess, said insertable member including, a base securable to said main body section within said recess;

a displaceable panel for selectively covering said base, said displaceable panel dimensioned to correspond to said insertable member;

separable fastener elements removably attaching at least a portion of said displaceable panel to said main body section; and a plurality of insert elements secured to said base, said plurality of insert elements and said displaceable panel secured together along a common edge, said plurality of insert elements disposed between said displaceable panel and said base, each of said insert elements including a backing member and a transparent member overlying said backing member, said transparent member having an access slot therethrough for insertion and removal of a sheet of graphical material between said backing member and said transparent member.

2. A stuffed doll according to claim 1 wherein said separable fastener elements comprise mating hook and loop components.

* * * * *